United States Patent [19]

Hardenbrook

[11] 4,408,864

[45] Oct. 11, 1983

[54] APPARATUS FOR INDUCING AN ELECTROSTATIC IMAGE IN A CONDUCTIVE MEMBER

[75] Inventor: James M. Hardenbrook, Altamonte Springs, Fla.

[73] Assignee: Xerox Corporation, Stamford, Conn.

[21] Appl. No.: 298,701

[22] Filed: Sep. 2, 1981

Related U.S. Application Data

[62] Division of Ser. No. 142,565, Apr. 21, 1980, Pat. No. 4,318,972.

[51] Int. Cl.[3] ..... G03G 15/18

[52] U.S. Cl. ..... 355/3 TE; 355/3 R

[58] Field of Search ..... 355/3 R, 3 TE, 3 BE, 355/16; 430/31, 48

[56] References Cited

U.S. PATENT DOCUMENTS

| | | | |
|---|---|---|---|
| Re. 29,632 | 5/1978 | Tanaka et al. | 355/11 |
| 2,866,903 | 12/1958 | Berchtold | 430/48 X |
| 2,951,443 | 9/1960 | Byrne | 430/126 |
| 3,041,167 | 6/1962 | Blakney | 430/125 |
| 3,234,019 | 2/1966 | Hall et al. | 430/48 |
| 3,703,376 | 11/1972 | Gundlach et al. | 430/48 |
| 3,738,855 | 6/1973 | Gundlach | 430/54 |
| 3,776,634 | 12/1973 | Williams | 430/48 |

*Primary Examiner*—R. L. Moses

*Attorney, Agent, or Firm*—Peter H. Kondo; Raymond C. Loyer; John E. Beck

[57] ABSTRACT

An electrostatic latent image residing on an electrically insulating surface used to induce a similar image on a sectionally conductive member by bringing one surface of the sectionally conductive member into proximity with the latent image while the opposite surface of the sectionally conductive member is brought to ground potential. The sectionally conductive member is then removed from proximity with the latent image. To prevent electrical breakdown during removal, a grounded electrode is placed adjacent the surface of the sectionally conductive member opposite the latent image but separated from the sectionally conductive member by a thin electrically insulating layer. A latent image is thus formed on the sectionally conductive member which can be developed by conventional means such as with electroscopic materials well known in the xerographic art.

17 Claims, 10 Drawing Figures

APPARATUS FOR INDUCING AN ELECTROSTATIC IMAGE IN A CONDUCTIVE MEMBER

This is a division, of application Ser. No. 142,565, filed Apr. 21, 1980, now U.S. Pat. No. 4,318,972.

This invention relates to a method for forming an electrostatic latent image by induction and, more particularly, a method for forming an electrostatic latent image on a sectionally conductive member by induction.

In the xerographic art, there has long been a need to develop a process wherein the photoreceptor is protected from damage and wear caused by its use in the xerographic process. Ideally, the photoreceptor in such process would not make physical contact with any other physical object. If such protection could be achieved, one could then design the photoreceptor to have the most favorable image-forming characteristics without the need to be mechanically strong so as to withstand the repeated image development and transfer steps normally found in the xerographic processes.

In the prior art, there have been many attempts to achieve this ideal wherein the photoreceptor is protected from physical contact with any other object in the xerographic process. The earliest attempt to achieve this objective was to cover the photoreceptor with an overcoating which, when applied to the photoreceptor, simply forms a protective cover. In such case, the latent image is developed on the surface of the protective coating utilizing the field forces emanating from the photoreceptor. This approach raised several problems, among them a reduced resolution or sharpness of the image because the electroscopic or toner materials used to develop the image reside on the surface of the protective layer. The separation of the toner material from the surface of the photoreceptor causes a reduction in the resolution of the image because the field forces emanating from the photoreceptor diverge above the photoreceptor. Thus, some compromise must be made when utilizing an overcoated, protected photoreceptor wherein the protective layer is interposed between the latent image on the photoreceptor and the toner material utilized to develop the latent image.

Other problems are created through the use of such protective coatings which are described in U.S. Pat. No. 3,041,167 to Blakney et al. As mentioned in said patent, the photoreceptor bearing a protective overcoating collects trapped charges which causes a degradation in the quality of the latent image. While the Blakney et al. patent offers a solution to this problem, one immediately notes the complications resulting from the use of an overcoated photoreceptor in such a manner.

A different attempt to achieve protection of the photoreceptor in the xerographic process is exemplified in U.S. Pat. No. 3,234,019 to Hall. A similar approach is described in U.S. Pat. No. 29,632 to Tanaka et al. In these processes, the problem of decreased resolution and trapped charges are overcome by utilizing a process wherein the electrostatic latent image created in the photoreceptor is transferred to the surface of the protective layer. The transfer of the electrostatic latent image from the surface of the photoreceptor to the surface of the protective layer bound thereto, is performed by a series of unique charging steps and light exposure. Once again, the increased amount of apparatus and number of process steps is readily apparent thus hindering this solution by a compromise between the desired result and a simple, inexpensive system.

In U.S. Pat. No. 3,738,855, there is disclosed an induction imaging system wherein a receiver sheet having controlled electrical conductivity is brought into virtual contact with a substrate carrying an electrostatic latent image. A latent image is formed on the receiving sheet but of less resolution and density than the original image. In a second embodiment, the image is developed on the receiver sheet while the receiver sheet is held close to the original latent image in an interposition development mode. Both embodiments provide images of reduced density and resolution.

There is needed, therefore, a simple, inexpensive system whereby a reusable photoreceptor in a xerographic process is protected from contact with the other components of the system during the creation, development and transfer of an image. Such process is needed which neither complicates the system nor creates internal problems with the photoreceptor which necessitates therapeutic measures to correct as noted above.

SUMMARY OF THE INVENTION

It is an object of this invention to provide a process for forming an electrostatic latent image byinduction from an image on a photoreceptor without contacting the photoreceptor with a component or material utilized in the process.

Another object of this invention is to provide a method whereby the electrostatic latent image on a reusable photoreceptor is utilized for the creation of a visible image without degradation of the latent image.

Another object of this invention is to provide an apparatus for forming an electrostatic latent image by induction from an image on an insulating surface without the need for contacting said insulating surface.

These and other objects of this invention are achieved by a process utilizing a sectionally conductive member which is prepared by embedding into an insulating sheet a plurality of electrically conductive paths, each path electrically insulated from the other. For example, an electrically insulating layer of resin may contain a plurality of fine electrically conductive wires running therethrough, each wire being completely surrounded by the electrically insulating resin material. The conductive ends of the conductive wires or paths in the layer are brought into proximity with an electrostatic latent image while the ends of the conductive paths or wires opposite those proximate with the latent image are brought to ground potential. The electrostatic latent image induces a charge within the conductive paths or wires of opposite charge to the latent image in the ends of the wires facing the latent image.

There is thus provided an imagewise pattern of potential in the conductive paths or wires facing the latent image. The layer containing the conductive path or wires is then removed from proximity with the electrostatic latent image. As the layer containing the conductive paths or wires is removed from proximity with the electrostatic latent image, the potential increases in the conductive paths or wires which will reach the point of electrical breakdown unless some measure is taken to prevent such breakdown. Electrical breakdown upon removal of the layer containing the conductive paths or wires is easily prevented by providing a grounded electrode on the surface of the layer containing the conductive paths or wires opposite the electrostatic latent image which grounded electrode is separated from the conductive material by a thin insulating layer.

The above-described process provides a duplicate of the original electrostatic latent image on the ends of the conductive paths or wires which can be developed or detected by any conventional means. It has been found that the original latent image on the insulating substrate is not degraded by the above-described process, and if such electrostatic latent image is inherently stable, it can be reused numerous times to provide numerous copies of the original electrostatic latent image in accordance with the process of this invention.

The process of this invention will be described by means of the following several embodiments thereof, which will be described with reference to the attached drawings in which.

FIGS. *4a–f* is a combined diagramatical and graphical description of the process of this invention.

Figure 5:
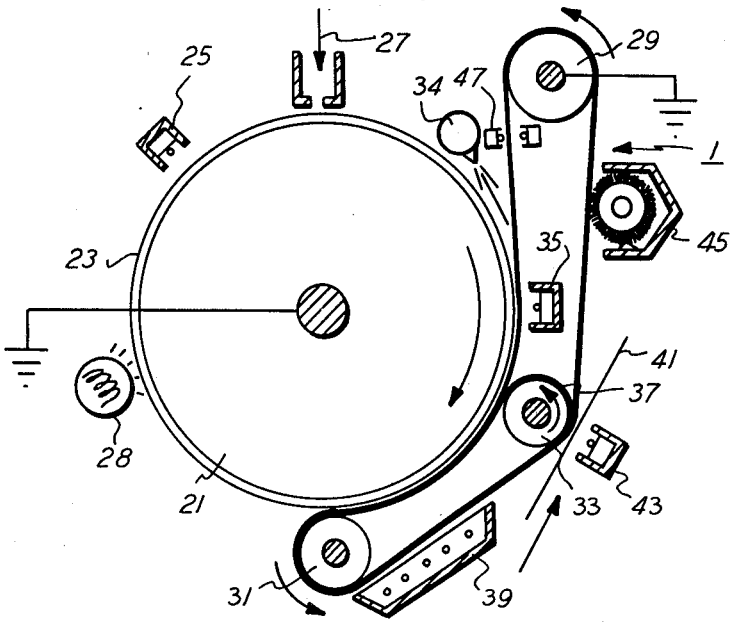

FIG. 5 is one embodiment of this invention utilizing a continuous process apparatus.

Figure 1:
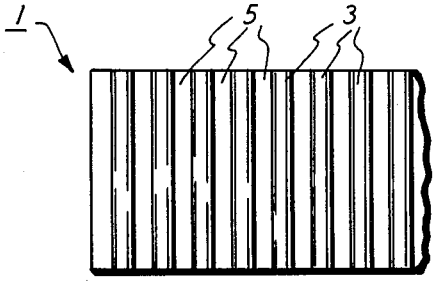
FIG. 1 is a cross-sectional view of the sectionally conductive member utilized in the process of this invention.

As mentioned above, the first step in the process of this invention is transferring an electrostatic latent image is to bring a conductive member into proximity with that image. In FIG. 1, is shown a portion in cross-section, of the sectionally conductive member 1 utilized in the process of this invention. Said sectionally conductive member 1 comprises conductive paths 3 extending through the entire thickness of the layer. Each of the conductive paths 3 are electrically insulated from each other by any suitable electrically insulating material such as an organic resin or plastic material 5.

Typically suitable conductive paths 3 comprise copper wire or other suitable metal material of small diameter. The resolution capability of the imaging method of this invention is related to the size of the conductive paths as well as the number of conductive paths per unit area. Thus, fine wire comprising such metals as aluminum, copper, brass, iron, steel or any common metallic conductor can be utilized. In addition, organic conductive material such as polystyrene sulfonic acid can also be employed, however, the use of such organic conductive paths may present greater difficulty in preparation than simply embedding fine wire in a plastic sheet.

The material utilized as insulating material 5 is preferably one having a low dielectric constant so as to provide adequate electrical insulation between each conductive path. Such materials typically include resins such as polystyrene, polyethylene, polypropylene, methacrylates such as polymethacrylate and polymethylmethacrylate, copolymers such as butadine-styrene copolymers and mixtures thereof. Other suitable materials such as rubber, porcelain, cork, etc. can also be utilized as insulating material 5. Typically a low dielectric constant in the range of from about 2 to about 6 is desired in the electrically insulating material 5.

The conductive member 1 may be constructed by any suitable method such as by casting wherein conductive wire is placed into the resin or plastic material while the material is still liquid and allowing the polymerization to proceed with the conductive wires in place. Alternatively, insulating material 5 can be melted and, while in the liquid state, the conductive paths installed. The layer is then formed by allowing the melted material to solidify. The thickness of the conductive member 1 may vary widely since most common metals have high electron mobility. However, in most typical applications, the layer is in the range of from about 3 mils to about 7 mils in thickness.

Figure 2:
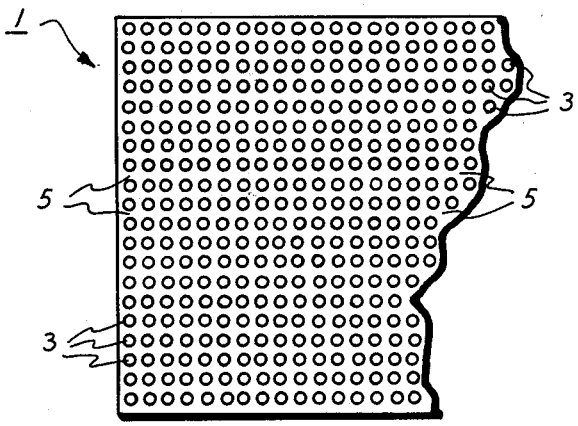
FIG. 2 is a plan view of the top surface of the sectionally conductive member employed in the process of this invention.

There is shown in FIG. 2, a plan view of the conductive layer 1 showing conductive paths 3 distributed about the surface and separated from each other by insulating material 5. The total surface area taken up by the conductive paths can vary widely, as mentioned above, and can cover from about 1 percent to about 90 percent of the total surface area. Of course, the resolution of the image may be modified by extreme reduction or increase in the number of conductive paths per unit area. Typically, the total surface area taken by conductive paths is in the range of from about 5 to about 50 percent. Typically, the conductive paths are in the range of from about 0.5 mils to about 3 mils in diameter while a diameter of about 1 mil has been found suitable.

Figure 3:
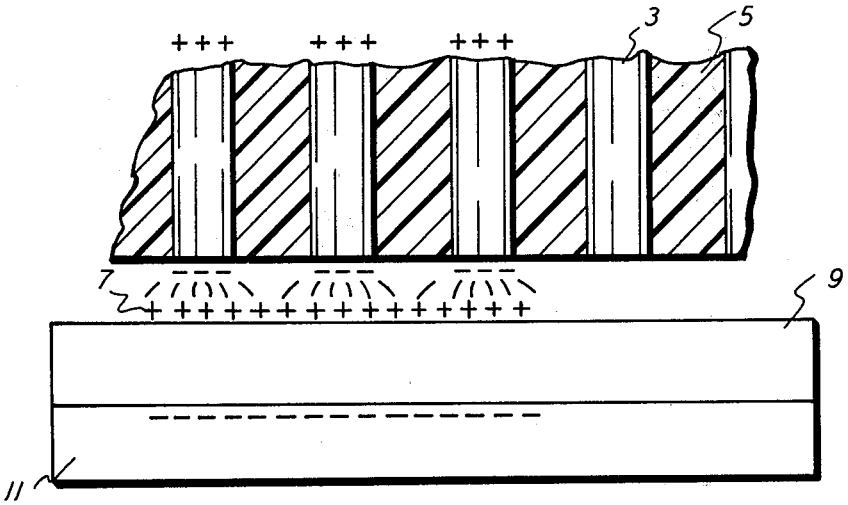
FIG. 3 is an expanded view of the sectionally conductive member placed adjacent a charged photoreceptor in accordance with the process of this invention.

In operation, sectionally conductive layer 1 is brought into close proximity with an electrostatic latent image and in FIG. 3 such condition is diagramatically shown. In FIG. 3, sectionally conductive member 1 is brought close to or touching a latent image 7 indicated by charges residing upon an insulating substrate 9. Typically, the insulating substrate is photoconductive so that a latent image can be established by simply charging the photoreceptor which resides on conductive substrate 11 and exposing the photoreceptor to a light image. There is thus shown, charges of the latent image in the unexposed areas of substrate 9 with counter charges at the interface of substrates 9 and 11. When conductive layer 1 is brought into close proximity with the latent image, mobile charges in conductive paths 3 are brought to the surface of conductive member 1 in those paths adjacent the latent image as indicated by the negative charges at the surface of layer 1 at the ends of conductive paths 3. Counter charges exist at the opposite ends of the conductive paths 3 as indicated by the positive charges at the opposite surface of layer 1.

In FIG. 3, one can plainly see that latent image 7 can induce charges in sectionally conductive layer 1 by simply bringing sectionally conductive layer 1 into close proximity with the latent image. The term "proximity" as employed herein and in the claims is intended to mean any distance from vertical contact to that distance in which the force field of the electrostatic latent image effects a charge distribution in the conductive paths. Of course, the greater the distance the conductive paths are situated from the electrostatic latent image, the lower will be the potential of the induced electrostatic latent image in the conductive paths. In order to provide a developable latent image in sectionally conductive layer 1, the charges shown on the surface of sectionally conductive layer 1 are trapped by the following sequence of steps. In FIGS. *4a–f*, there is illustratively displayed both diagramatically and graphically the field effects occurring during the process of this invention whereby the charges appearing in FIG. 3 at the surface of sectionally conductive layer 1 are trapped and become developable by creating a contrast field in sectionally conductive layer 1.

Figure 4A:
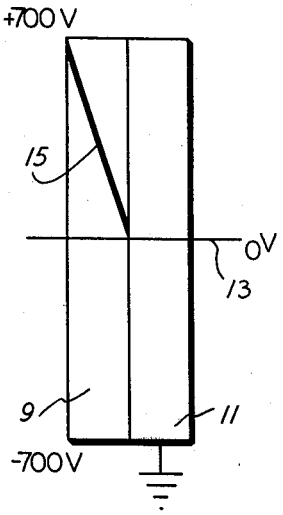

In FIG. 4a, there is shown conductive substrate 11 supporting electrically insulating substrate 9 which can be simply a layer sufficiently insulating to support the electrostatic charge residing thereon. As mentioned above, the most convenient layer for this purpose is a photoconductive layer well known in the xerographic art. Typical layers include binder plates comprising a photoconductive material such as selenium dispersed in a resin binder, sensitized zinc oxide in a binder or any convenient photoreceptor material. Alternatively, insulating layer 9 can be of any electrically insulating material which can receive the electrostatic charges imposed in imagewise fashion such as charging through a mask or stencil or by providing an imagewise charge in any convenient manner. Typical insulating materials can include those mentioned above for insulating material 5 or any other suitable material.

The electrical field conditions shown in FIGS. 4a–f are graphically illustrated in conjunction with line 13 indicating 0 voltage condition. Heavy line 15 indicates the direction and amount of the electrical field existing in the various layers graphically illustrated in FIGS. 4a–f. In FIG. 4a, an electrical field of 700 volts is displayed by line 15 across insulating layer 9 while layer 11 is shown to carry the ground plane bias.

Figure 4C:
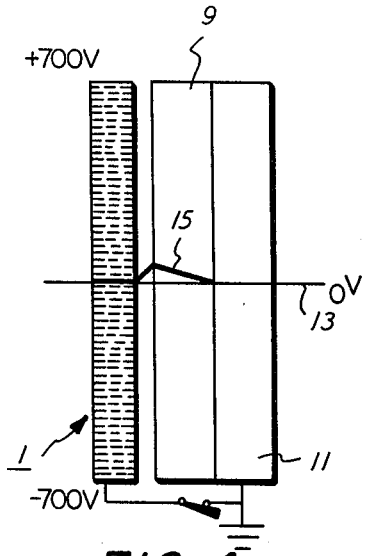
Figure 4B:
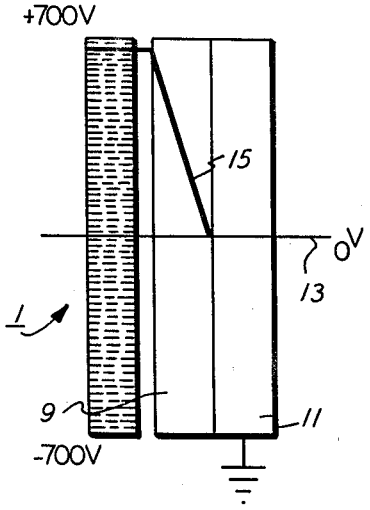

In FIG. 4b, concave layer 1 is shown being brought into close proximity with insulating layer 9 carrying the latent image. At this point, there is no change in the electrical field across insulating layer 9. In FIG. 4c, there is shown in the step of electrically grounding of the conductive paths 3 in layer 1 to the same bias as applied to layer 11. This step can be conveniently accomplished in several ways. A corona discharge device operating with an A.C. current set at 0 volt potential can be passed over the exposed surface of layer 1. Alternatively, a conductive member can be brought across the surface of layer 1, contacting the ends of conductive paths 3 thereby, at least momentarily, bringing the conductive paths to the same potential as the ground plane in layer 11. The result of this step is shown in FIG. 4c as reducing the electrical field across the photoreceptor 9 and creating a small electrical field in the gap separating layers 1 and 9.

Figure 4D:
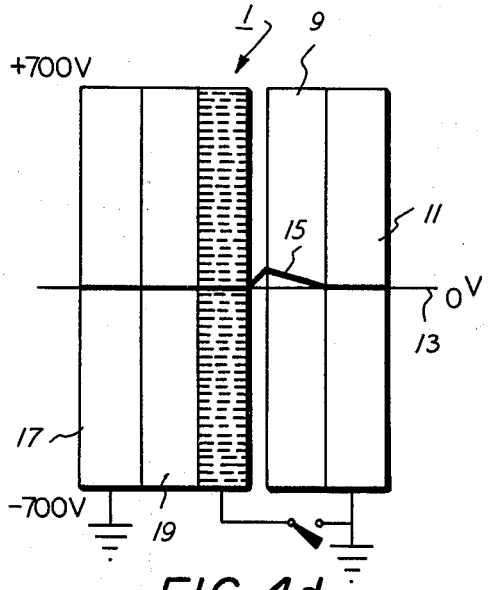
Figure 4E:
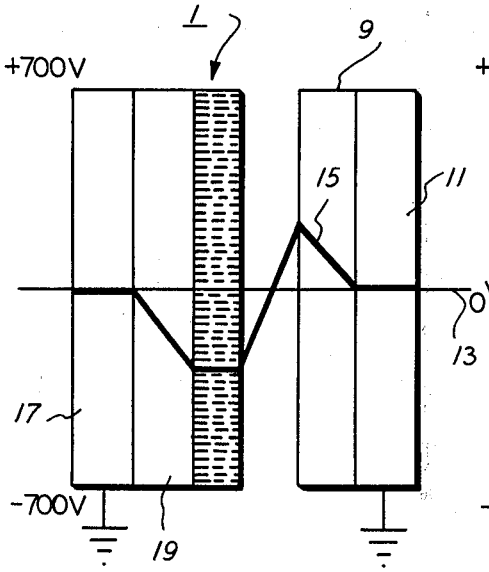
Figure 4F:
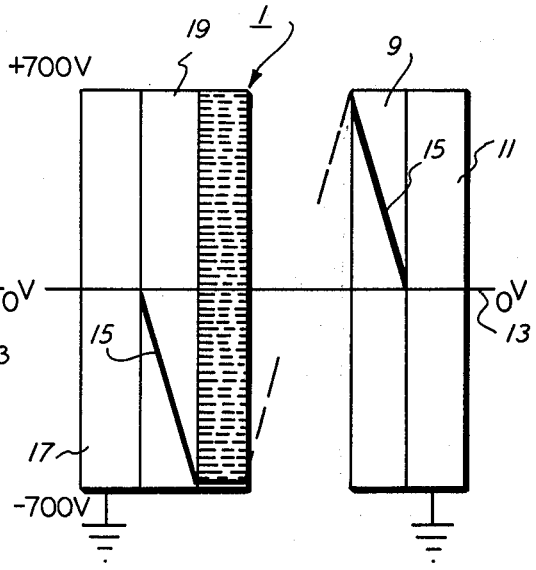

In FIG. 4d, there is shown the initial result of the step of separating the conductive layer 1 from the latent image supported on insulating substrate 9. As conductive layer 1 is withdrawn from proximity with the latent image on insulating substrate 9, there is graphically indicated in FIG. 4d an increasing field being established across insulating substrate 9 while an approximately equal and opposite potential is indicated at each surface of sectionally conductive layer 1. As mentioned above, during the separation process, a grounded layer is provided on the back of sectionally conductive layer 1 separated from the sectionally conductive layer by a thin insulating layer in order to prevent the potential caused by separation to increase beyond the electrical breakdown potential of the gap as the layers are being separated. Thus, in FIG. 4d there is provided a grounded conductive layer 17 separated from sectionally conductive layer 1 by a thin electrically insulating layer 19. Electrically insulating layer 19 can comprise any suitable electrically insulating material and is typically in the range of from about 0.5 mil to about 6 mil in thickness. Preferably, the electrically insulating layer 19 is in the range of from about 1 mil to about 3 mil in thickness. The dielectric constant of layer 19 is preferably low so as to support the electrical field opposed across it as indicated in FIGS. 4d–f. The same or different resins as mentioned above for sectionally conductive layer 1 can be utilized in layer 19. Other suitable insulating materials include paper, rubber or fabric either synthetic or natural fibers.

In FIG. 4e, there is shown the result of further separation of sectionally conductive layer 1 combined with layers 17 and 19 from the electrostatic latent image on electrically insulating layer 9. From the graph line 15, one can see that the electrical field increases across layers 9 and 19 as the distance between layers 1 and 9 increase. In FIG. 4f, the distance between layers 1 and 9 increase to the extent such that the original potential across insulating substrate 9 is restored while layer 1 is brought to the opposite and approximately equal voltage supported by the electrical field across insulating layer 19. There is thus provided, as indicated in FIG. 4f, an electrostatic latent image residing in sectionally conductive layer 1 which is developable by deposition of electrically charged particles in typical fashion known in the art of xerography. The image can also be detected by any other suitable means.

In FIGS. 4a–f, thicknesses are not drawn with regard to any particular relative scale. That is, since conductive layers have no thickness with respect to its electrical characteristic within the range of voltages normally utilized in electrostatic imaging processes, such thicknesses are shown for the convenience of illustration only and are not intended to illustrate actual size with respect to the insulating layers illustrated. Likewise, the relative thicknesses of the electrically insulating layers are also illustrative and bear no relationship to their dielectric thicknesses relative to each other.

In FIG. 5, there is shown an apparatus for automatically and continuously producing copies of an image by the process of this invention. In FIG. 5, there is shown a typical photoreceptor drum 21 containing a grounded support for a photoreceptor layer 23 on its surface. A latent electrostatic image is created on photoreceptor 23 by typical xerographic means of electrostatically charging the photoreceptor such as by corotron 25 and exposing it to a light image at imaging station 27. The thus created electrostatic latent image is carried by rotation of the drum, as indicated in FIG. 5, into close proximity with conductive layer 1 entrained over grounded roller 29 and rollers 31 and 33. A small gap is maintained between sectionally conductive layer 1 and the surface of photoreceptor 23 by any suitable means such as, in the illustrative embodiment of FIG. 5, an air bearing 34. As is indicated in FIG. 5, air is supplied into the gap under pressure to maintain a predetermined distance between conductive layer 1 and the electrostatic latent image residing on layer 23 which is typically in the range of from about 0 to about 0.5 mil. Preferably, the distance maintained between conductive layer 1 and the electrostatic latent image is in the range of about 0.01 mil to about 0.1 mil. As in any xerographic process, the latent image on layer 23 is erased by actuating light 28.

Sectionally conductive layer 1 traveling at the same rate as the surface of photoreceptor 23 passes a grounding means while in close proximity to the photoreceptor layer 23, shown in FIG. 5 as corotron 35 which, as mentioned above, can be a corotron operated with A.C. current set at 0 potential. Corotron 35 serves as a grounding means to bring the electrically conductive paths to the same potential as the ground plane of the photoreceptor drum. After the grounding of the exposed ends of the conductive paths in conductive layer 1, the grounded conductive web 37 entrained over rollers 31 and 33 is brought into contact with sectionally conductive layer 1. Grounded conductive web 37 carries on its surface a thin dielectric layer which separates the grounded conductive web from the electrically conductive paths in sectionally conductive layer 1. The thin dielectric layer on web 37 is not shown in FIG. 5. Sectionally Conductive layer 1 and grounded conductive web 37 travel together over roller 31 as the sectionally conductive layer 1 is separated from proximity with the surface of the photoreceptor 23. Sectionally conductive layer 1 now carrying a duplicate of the electrostatic latent image on photoreceptor 23 is brought into a development zone generally shown in FIG. 5 as 39. The means utilized to develop the latent image on sectionally conductive layer 1 can be any suitable means such as powder cloud, cascade development of carrier and toner or any other suitable known means to bring electroscopic material into contact with an electrostatic latent image. Subsequent to development, both grounded conductive web 37 and sectionally conductive layer 1 travel together to a transfer station shown generally as 41 whereat the developed image is transferred to an image substrate typically with the aid of a transfer corotron 43. The image is subsequently fixed to the desired image substrate which step is typical and well known in the art and is not shown in FIG. 5.

After the transfer step, sectionally conductive layer 1 proceeds through cleaning station 45 to remove residual electroscopic material also well known in the art. Any residual electrostatic latent image residing on sectionally conductive layer 1 is removed by any suitable means such as by charging both sides to zero potential by corotrons 47.

After elimination of the latent image on sectionally conductive layer 1, the process may be repeated numerous times by the cyclic rotation of the above-described members. The creation of an electrostatic latent image in sectionally conductive layer 1 by the process of this invention has been found to be non-destructive to the original latent image on photoreceptor layer 23. Thus, if the electrostatic latent image residing on photoreceptor layer 23 is stable, such image can be utilized repeatedly for multiple images on sectionally conductive layer 1. Such non-destructive transfer is graphically illustrated by FIG. 4*f* wherein the original potential and electrical field cross insulating substrate 9 is described. Of course, as is well known in the art, the electrostatic latent image on photoreceptor layer 23 can be removed and replaced by another image, when a reusable photoreceptor is provided.

The above-described process enables the use of photoreceptors not normally capable of being utilized in the xerographic process. As can be seen from the above-described process and apparatus, the surface bearing the original electrostatic latent image is not touched by any component of a machine or process. On the other hand, the sectionally conductive layer 1 can be constructed of durable materials so as to easily withstand the repeated development and transfer of images as well as the cleaning step. The materials utilized for sectionally conductive layer 1 are inexpensive and readily available, as well as durable. In accordance with the process of this invention, the only significant consumable item is the developer utilized to develop the image on sectionally conductive layer 1. Accordingly, great savings can be achieved through the use of this process and any optimum apparatus designed to carry out the process.

It is to be understood that the above-described methods and arrangements are simply illustrative of the application of the principles of the invention and that many modifications may be made without departing from the spirit and scope thereof.

What is claimed is:

1. An apparatus for creating an electrostatic latent image in a sectionally conductive layer, said layer comprising an electrically insulating material having extended therethrough electrically conductive paths, comprising:

(a) a sectionally conductive layer in the form of a web entrained over rollers;

(b) a photoconductive surface rotatably mounted on a grounded electrode;

(c) means to electrostatically charge said photoconductive surface and expose said charged surface to an imagewise pattern of light;

(d) means to bring said photoconductive surface and said conductive layer into proximity with each other including means to maintain a predetermined distance between said surface and layer;

(e) means to ground said conductive paths on the side opposite said photoreceptor surface while in proximity to said photoreceptor surface;

(f) means to bring a grounded electrode adjacent said conductive layer coincident with means to separate said photoreceptor surface and said conductive layer;

(g) means to develop the latent image created on said conductive layer and to transfer said developed image to an image substrate;

(h) means to clean said conductive layer of untransferred residue of said developed image; and (i) means to erase the electrostatic latent image on said photoreceptor and on said conductive layer.

2. The apparatus of claim 1 wherein said means to maintain a predetermined distance between said photoreceptor surface and said conductive layer comprises an air bearing.

3. The apparatus of claim 1 further including electrostatic means to aid the transfer of said developed image from said conductive layer to an image substrate.

4. An apparatus for creating an electrostatic latent image in a sectionally conductive layer, said layer comprising an electrically insulating material having extended therethrough electrically conductive paths comprising:

(a) an electrically insulating surface upon which an electrostatic latent image is formed;

(b) means for bringing said conductive layer into proximity with said surface;

(c) means for applying substantially the same electrical bias to the conductive paths on the side of said sectionally conductive layer opposite said latent image and to the side of said electrically insulating surface opposite said sectionally conductive layer;

(d) means to separate said sectionally conductive layer and said electrically insulating surface from proximity; and (e) means for providing grounded electrode adjacent said conductive paths simultaneous with separation of said sectionally conductive layer and said electrically insulating surface so as to induce a corresponding latent image into said sectional conductive layer.

5. An apparatus of claim 4 wherein said electrically insulating surface is a photoconductive insulating surface residing upon a grounded electrode.

6. The apparatus of claim 5 wherein said photoconductive insulating surface is in the form of a rotatable drum.

7. The apparatus of claim 6 wherein said sectionally conductive layer is in the form of a web entrained over rollers.

8. The apparatus of claim 4 wherein said electrically insulating surface and said sectionally conductive layers are spaced apart by means of an air bearing.

9. The apparatus of claim 7 wherein said web is separated from said rotatable drum by means of an air bearing.

10. The apparatus of claim 4 wherein said grounded electrode is in the form of a web entrained over rollers.

11. The apparatus of claim 10 wherein said rollers supporting said grounded electrode are common with at least a portion of the rollers supporting said sectionally conductive layer.

12. The apparatus of claim 4 further including means for developing the latent image created on said sectionally conductive layer.

13. The apparatus of claim 6 further including means to develop the image created on said sectionally conductive layer.

14. The apparatus of claim 12 further including means to transfer said developed image to an image substrate from said sectionally conductive layer.

15. The apparatus of claim 13 further including means to transfer said developed image from said sectionally conductive layer to an image substrate.

16. An apparatus for creating an electrostatic latent image in a sectionally conductive layer, said layer comprising an electrically insulating material having extended therethrough electrically conductive paths, the surface of the sectionally conductive layer comprising from about 1 percent to about 90 percent of conductive paths, comprising:

(a) an electrically insulating surface upon which an electrostatic latent image is formed;

(b) means for bringing said conductive layer into proximity with said surface;

(c) means for applying substantially the same electrical bias to the conductive paths on the side of said sectionally conductive layer opposite said latent image and to the side of said electrically insulating surface opposite said sectionally conductive layer;

(d) means to separate said sectionally conductive layer and said electrically insulating surface from proximity; and (e) means for bringing a grounded electrode adjacent said conductive paths simultaneous with separation of said sectionally conductive layer and said electrically insulating surface so as to induce a corresponding latent image into said sectional conductive layer.

17. The apparatus of claim 16 wherein said surface area of said sectionally conductive layer comprises from about 5 percent to about 50 percent of conductive paths.

* * * * *